US006260199B1

(12) United States Patent
Grunstein et al.

(10) Patent No.: US 6,260,199 B1
(45) Date of Patent: Jul. 17, 2001

(54) SWIMWEAR WITH BUOYANT NECK SUPPORT AND BODY PANELS

(75) Inventors: Eugen Grunstein; Anthony Charles Grunstein, both of Darling Point (AU)

(73) Assignee: G.B.L. Australia Pty. Limited, Surry Hills (AU)

( * ) Notice: Subject to any disclaimer, the term of this patent is extended or adjusted under 35 U.S.C. 154(b) by 0 days.

(21) Appl. No.: 09/381,668

(22) PCT Filed: Jan. 8, 1999

(86) PCT No.: PCT/AU99/00007

§ 371 Date: Oct. 19, 1999

§ 102(e) Date: Oct. 19, 1999

(87) PCT Pub. No.: WO99/35924

PCT Pub. Date: Jul. 22, 1999

(30) Foreign Application Priority Data

Jan. 19, 1998 (AU) ..... 52145/98

(51) Int. Cl.[7] ..... A41D 7/00; B63C 9/08

(52) U.S. Cl. ..... 2/69; 2/67; 441/115

(58) Field of Search ..... 441/115, 117, 441/106; 2/67, 69

(56) References Cited

U.S. PATENT DOCUMENTS

| | | | | |
|---|---|---|---|---|
| 2,893,020 | * | 7/1959 | Miller | 9/20 |
| 3,181,183 | * | 5/1965 | Allen . | |
| 4,871,338 | * | 10/1989 | Hoffman | 441/116 |
| 5,184,968 | * | 2/1993 | Michalochick et al. | 441/116 |
| 5,459,874 | * | 10/1995 | Meredith | 2/67 |
| 5,588,892 | * | 12/1996 | McMahon | 441/116 |
| 5,775,967 | * | 7/1998 | Lacoursiere et al. | 441/115 |
| 5,823,838 | * | 10/1998 | Darcy et al. | 441/106 |

* cited by examiner

*Primary Examiner*—John J. Calvert
*Assistant Examiner*—Robert H. Muromoto, Jr.
(74) *Attorney, Agent, or Firm*—Smith-Hill and Bedell

(57) ABSTRACT

A swimwear garment made of ultra-violet resistant material encloses the body of a child when fastened-up, and has a back zip (3), sleeves (2A), leg openings and a neck opening (4). The garment incorporates buoyant panels (8) at its back and a front panel (11) which are formed with crease lines (9, 10, 14, 16) enabling them to conform closely to the child's chest without obstructing its movement during swimming. A flexible soft neck roll (6) of closed-cell, buoyant, foamed plastics material encircles the child's neck and holds the chin above water.

12 Claims, 4 Drawing Sheets

SWIMWEAR WITH BUOYANT NECK SUPPORT AND BODY PANELS

FIELD OF THE INVENTION

Figure 1:
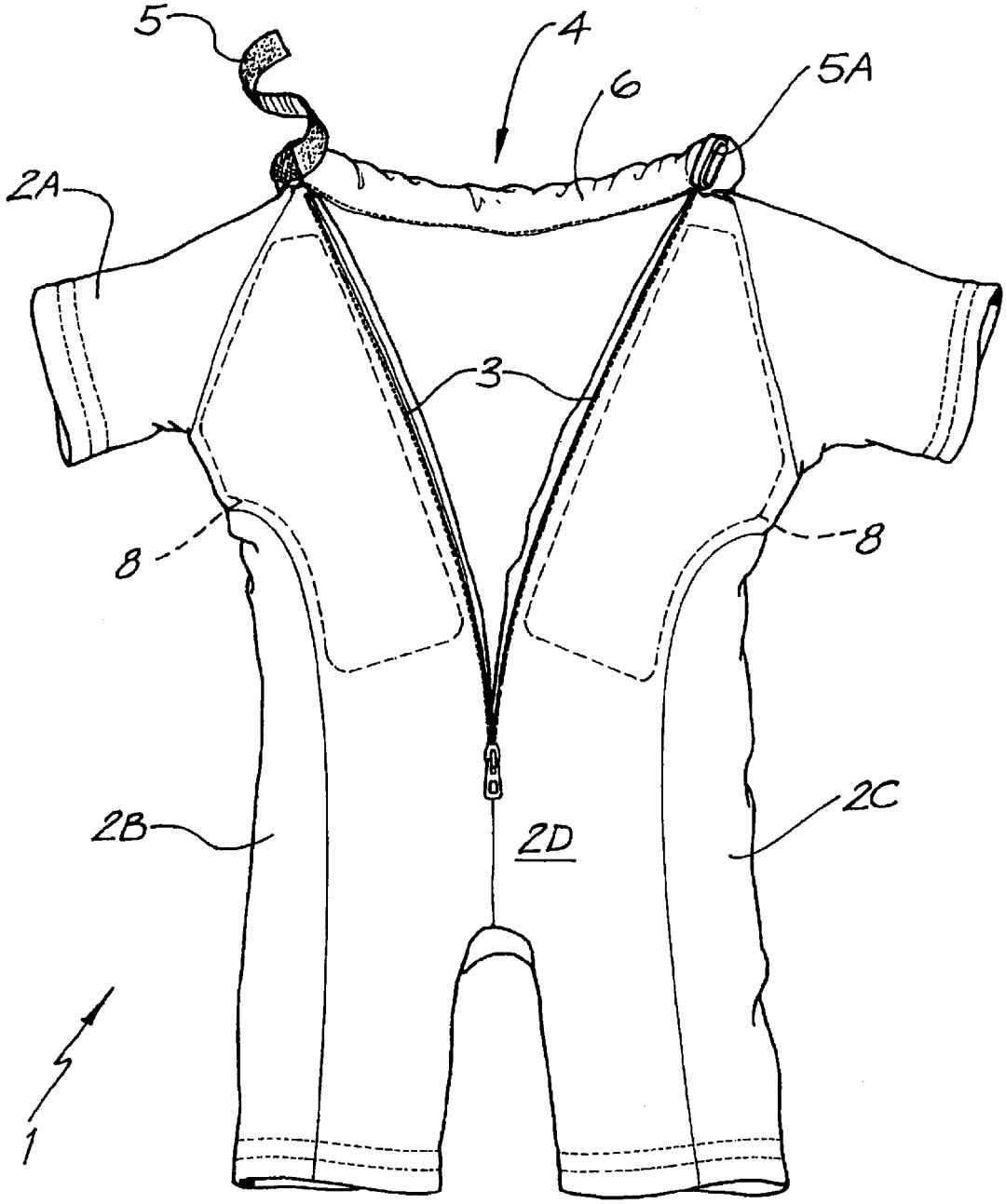

THIS INVENTION relates to swimwear and is more specifically concerned with swimwear which serves three functions, namely, enhances buoyancy of a swimmer; is shaped to offer minimum obstruction to movements which the swimmer must learn in order to swim correctly; and, protects at least the central body of the swimmer from direct exposure to harmful solar radiation.

STATE OF THE ART

Swimming costumes have been recently developed which cover at least the entirety of a swimmer's central body so that only the swimmer's head, arms and legs are directly exposed to harmful solar radiation. The material of the costume is chosen to provide at least some resistance to the penetration of harmful ultra-violet light. The arms and legs of the costume usually cover the upper portions of the swimmer's arms and legs. The costume itself has a neutral buoyancy and fits snugly on the swimmer. It is almost always held in place by a zip fastener extending from the swimmer's neck down to the lower back.

Various forms of flotation devices have also been developed to maintain a swimmer's head above water and to provide positive buoyancy. These devices may take the form of strings of buoyant beads, buoyant waist-coats, or flotation pads or blocks attached to the outside of a garment worn by a swimmer. Although such devices prevent the wearer from sinking in the water, they do not leave the wearer's arms and legs and head free to assume the positions and carry out the motions which are necessary in order to learn to swim.

OBJECT OF THE INVENTION

An object of the invention is to provide a garment which will provide the wearer with positive buoyancy and some degree of protection from solar radiation, and which will allow the wearer to carry out arm, leg and head movements necessary for swimming while allowing the wearer to assume the horizontal position in the water of a swimmer.

THE INVENTION

In accordance with the present invention a swimwear garment designed to cover a child's body has arm, neck and leg openings to receive the child's arms, neck and legs respectively, a flexible buoyant neck support which locates beneath the child's chin and maintains it above water and, a buoyant flexible body panel or panels incorporated into the inside of the garment and surrounding the child's chest; the buoyancy of the panel or panels and neck support being so selected that the child can move its arms and legs with a swimming action while the child's body can be maintained in a non-vertical position and its chin is always held above the water by the buoyant neck support beneath it.

PREFERRED FEATURES OF THE INVENTION

The panels may be permanently secured by stitching them into pockets into the inside of the garment. The pockets may be permanently closed or designed with a closable opening to enable the panel or panels to be slid into their respective pockets and then retained in position.

The panels are so shaped that they do not materially interrupt the smooth external outline of the garment on the body of the wearer.

Preferably, the panels are made from soft, non-interlinked closed cellular foam and each panel may be creased to provide it with a hinge line about which portions of the panel can bend with respect to one another. The crease lines are positioned to coincide with those regions of the body about which other regions of the body move. The stiffness of the panels does not then impede the wearer from performing arm movements associated with swimming.

Suitably the panels cover the upper portions only of the back and front of the wearer and do not extend down beyond the wearer's waist.

The swimwear is preferably made from material which provides a degree of protection against ultra violet light. One such material is Nylon Elastane (trade mark).

In the preferred arrangement a soft neck roll of flexible foamed plastics material is provided to encircle the swimmer's neck and which is positioned at the upper end of a zip fastened extending down the back of the garment to the position of the wearer's waist.

INTRODUCTION TO THE DRAWINGS

The invention will now be described in more detail, by way of example, with reference to the accompanying diagrammatic drawings, in which:

IN THE DRAWINGS

Figure 2:
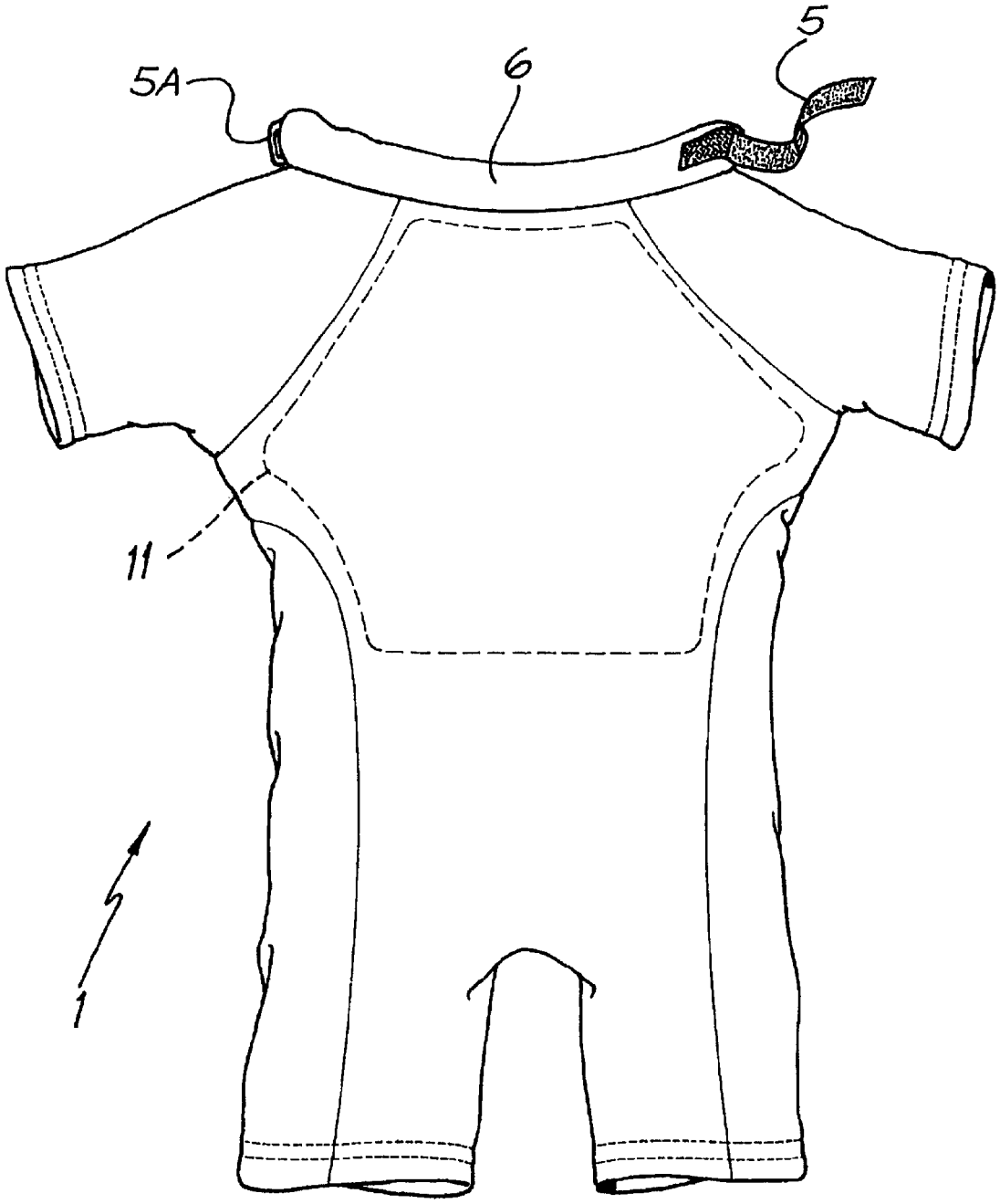
Figure 3:
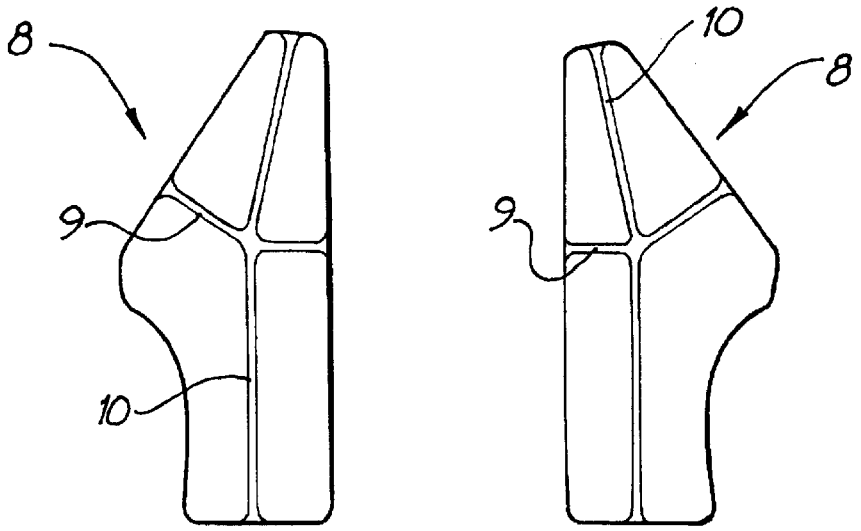
Figure 4:
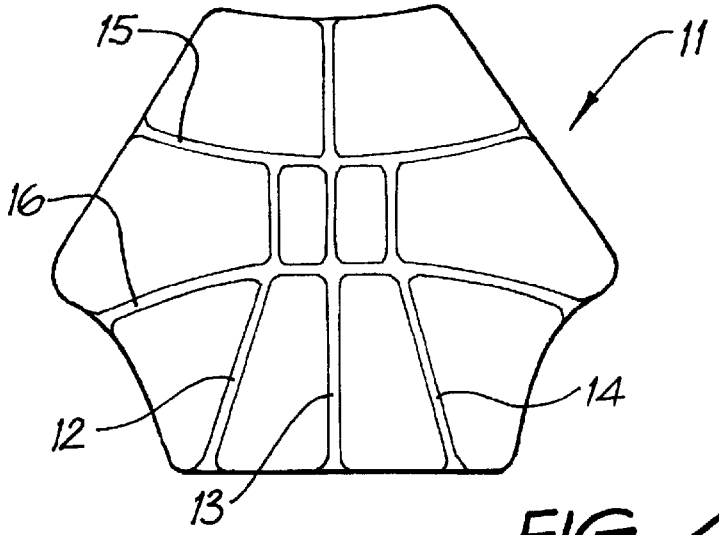
Figure 5:
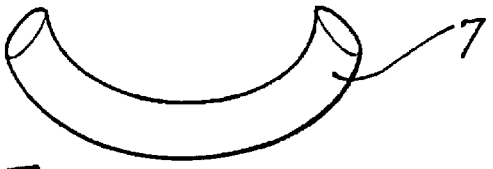
Figure 6:
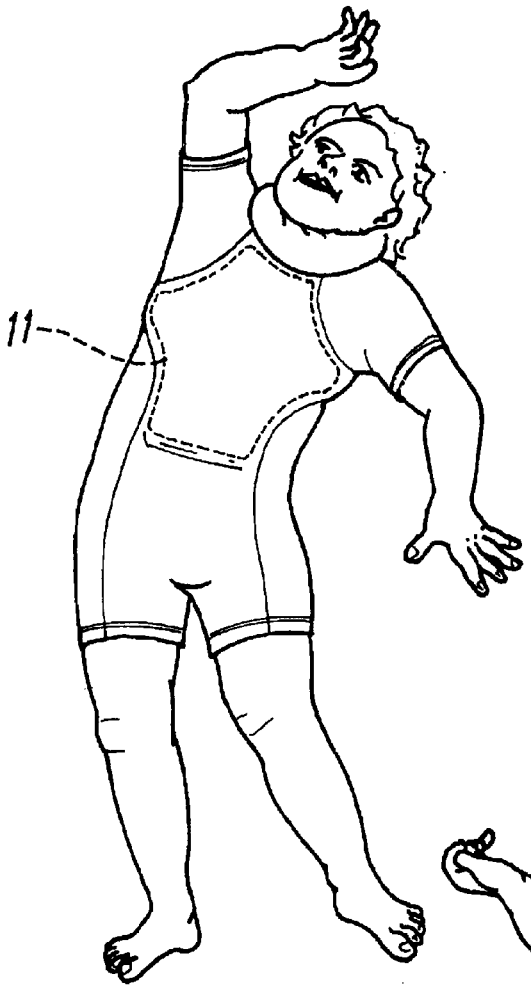

FIG. 1—is a back view of swimwear with a rear-opening closable by a zip;

FIG. 2—is a front view of the swimwear of FIG. 1;

FIG. 3—shows two buoyant foamed plastics panels which are respectively incorporated into opposite sides of the rear of the swimwear behind the wearer's chest;

FIG. 4—shows a buoyant foamed-plastics panel which is incorporated into the front of the chest portion of the swimwear;

FIG. 5—shows a neck support roll also made of buoyant soft cellular plastics material and which is incorporated into the neck of the swimwear;

FIG. 6—is a front view of a child wearing the garment; and

Figure 7:
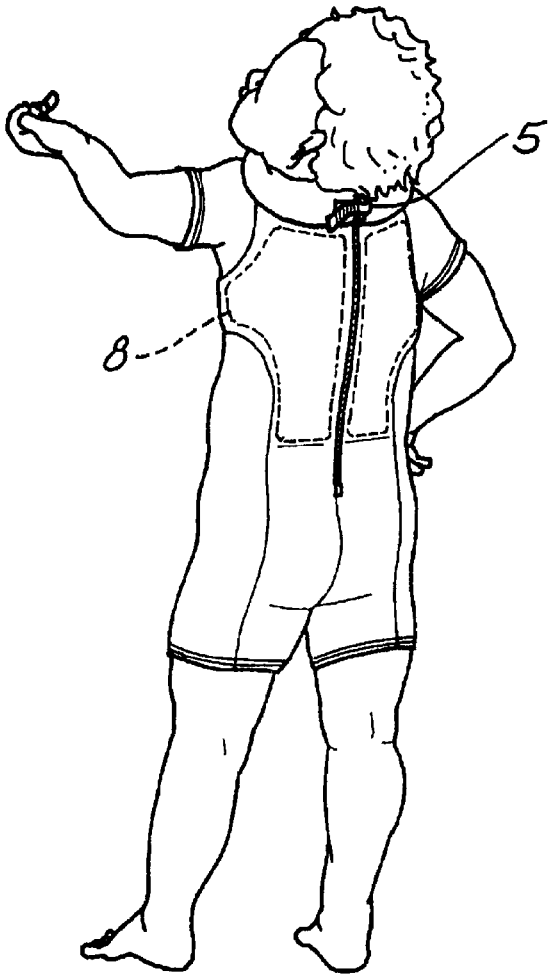

FIG. 7—is a rear view of the child of FIG. 6.

DESCRIPTION OF PREFERRED EMBODIMENT

FIG. 1 shows a swimwear garment 1 made from stitched-together knitted external areas 2A, 2B, 2C and 2D of a material commercially known under the trade mark NYLON ELASTANE. This material has a relatively high resistance to penetration by ultra violet light and therefore provides the wearer with some protection against skin damage from the sun's rays. The garment illustrated is designed for a child of between twelve and sixteen kilos weight and aged from three to four years old. It totally covers the child's body when zipped up the back and has openings through which the child's neck, arms and legs can extend.

The garment is provided at its back with a zip fastener 3 for closing a back opening 4 when the child is dressed in the garment. A rip fastener strip 5, which is optional, is made from VELCRO (trade mark) and is connected to one side of the neck opening of the garment and is designed to be passed through a plastics loop 5A attached to the other side of the neck opening and then folded back on itself in order to secure it to itself. The strip 5 and loop 5A may be dispensed with if the zip fastener 3 extends fully up the back of the neck opening.

The neck portion of the garment is shown at 6 and incorporates a buoyant soft flexible roll 7 of circular cross-section and made from a closed-cell or non-linked polyethylene foamed material. This roll is shown more clearly in FIG. 5 and passes through a neck tunnel formed in the fabric of the garment.

The upper portion of the back of the garment shown in FIG. 1, incorporates two flat flexible panels 8 (shown in FIG. 3) made of the same material as the roll 7. As shown in FIG. 3, the foamed material of each panel 8 is provided with broad crossing crease lines 9 and 10 formed by compressing the material of the panel flat along the line of the crease, and which enable the panel to flex around the child's chest, and to flex when the child bends forwards, backwards or sideways. The former flexing movement is permitted by the crease line 9, and the latter flexing movement is permitted by the crease line 10. The shape and positioning of these crease lines has been found by experiment and testing to be the best to offer least resistance to the natural movement of the child's body when learning to swim. The crease lines are broad, being about 75 mm wide and are formed by heat compression of the panes so that they lie intermediate the front and back surfaces of the panels.

The front of the garment shown in FIG. 2, contains a six-sided flat chest panel 11 made from the same material as the panels 8. The panel 11 is shown in more detail in FIG. 4 and is provided with three upright crease lines referenced 12, 13 and 14 which permit the panel to snugly fit around the front of the child's chest. Two further oppositely curved crease lines 15 and 16 allow the panel to yield when the child bends forwards or backwards. The edges and corners of the panel are rounded and are so positioned in the finished garment that they do not cause discomfort to the wearer. The thickness of the panels 8 and 11 is about 2.6 cm. and the diameter of the neck roll 7 is about 3 cm.

USE OF PREFERRED EMBODIMENT

Referring to FIGS. 6 and 7, it will be seen that the child is fitted into the garment by placing its legs through the two leg openings, respectively, and then passing the child's arms through the two arm-openings. The zip 3 is drawn up so that the chest and back portions of the garment closely surround the child's body and the two ends of the neck roll of the garment are drawn together by raising the back zip 3 to enclose the child's body snugly in the garment and then passing the rip fastener strip 5 through the loop 6 and folding it back on itself to adhere to a self-adhering portion of the strip. The roll 7 then encircles the child's neck beneath its chin to ensure that the child's chin is always held above the level of the water.

It will particularly be noted that as the flat chest and back panels shown in FIGS. 3 and 4 lie against the inside of the garment, the outside of the garment remains smooth and free of external projections which would otherwise interfere with the free movement of the child's arms and neck when learning to swim. Also the absence of projections allows the movement of the child's body through the water to take place smoothly. This is not the case with garments having external buoyant projections.

The panels are contained in respective pockets in the garment and the fabric covering the panel on the inside and which is thus next to the child's body, is stitched to the rest of the garment around the edge of the panel. The lines of stitching are spaced from the child's skin by almost the thickness of the panel, so that the stitchlines do not bear against the child's skin.

The above described garment is light and is safe for the child to use as it cannot ride up the child's chest, and the neck roll 7 is thus prevented from jolting the child's neck upwardly, if the child jumps into the water. The child can also move its arms and legs freely as the buoyancy is provided by flat panels which fit snugly around the child's chest and do not project outwardly from the outside surface of the garment. This makes easier the task of teaching the child to swim as it can assume a nearly horizontal position in the water while its chin is still held above the water's surface. The child is also well protected by the garment from solar ultra-violet radiation, and, when running around in the garment the buoyancy panels are not immediately visible or unsightly.

In one example of the swimwear illustrated, it is capable of supporting a four-year old child weighing about 14 kg without sinking, and weighs only about 160 grams. The neck to crotch distance of the garment is 50 cms. and the circumference of the leg opening is about 23 cms. and that of the arm opening is about 20 cms. The inner circumference of the neck opening is about 30 cms.

MODIFICATION OF PREFERRED EMBODIMENT

In an unillustrated variation of the preferred embodiment the buoyancy panels are sold separately from the garment which is provided with open pockets on its inside for the reception of respective panels. The pockets can be closed after insertion of the respective panels, by means of stud or "velcro" (trade mark) fasteners. This variation allows panels of the same external dimensions but of different thicknesses to be provided to suit children of the same size but of different weights. Thus a heavy four-year old child will be provided with thicker panels then a light four-year old, in order to provide more buoyancy.

A key feature in the pleasing external appearance of the garment when worn by a bather, is the inconspicuousness of the panels providing the bouyancy. The panels are not only free from external bulges which are unsightly and impede the flow of water over the surface of the garment, but also the absence of bulges enables a child being taught hot to swim to move its arms freely in the correct way to achieve a good stroke. The crease lines dividing the panels into separate zones lie about half a centimeter inwardly from the surface of the panel in contact with the outer fabric layer of the garment. Thus although the panel is normally flat when the garment is not being worn, the panels flex into a concave shape to conform to the external profile of the child's body when the garment is being worn. This flexing, which is permitted by the crease lines acting as hinges between different zones of the panels, causes the outer surfaces of the panel zones to move apart slightly, while the inner surfaces of the zones move slightly towards one another. Thus, to the child the crease lines are not noticed against its skin as they are cushioned by the inner fabric layer of the garment, but the outer fabric layer is pulled taut over the crease lines by the slight separation of the outside surfaces of the zones of the panels, to provide the garment with a relatively smooth external appearance. The rounding of the corner edges of the panel zones assists the creation of the smooth external appearance of the garment when worn.

What is claimed is:

1. A swimming costume suitable to be worn by a child learning to swim, the swimming costume including:

a fabric garment for covering the child's body while having openings for the child's arms, legs and neck;

a buoyant neck roll providing buoyancy at the child's neck; and buoyant plastics panels of flattened flexible from provided interiorly of the garment at positions at which normal body movements of the child are not obstructed, the panels being spaced around the child's chest and upper back region and providing the costume with a relatively smooth external appearance;

and wherein the panels are formed with crease lines at predetermined locations to facilitate flexing of the panels along predetermined lines so as to accommodate normal chest and back movements of the child occurring while swimming in water or playing on dry land, areas of the panels between the crease lines being uniformly thicker than elsewhere to maximize buoyancy of the panels in zones where substantial flexing of the panels is not required by said normal chest and back movements of the child.

2. A costume as claimed in claim 1, including a front panel and two back panels, each panel having said means formed by crossing crease lines to aid its flexibility and to offer low resistance of the panel to the movements of the child's body while learning to swim.

3. A costume as claimed in claim 1, in which the neck roll comprises a flexible cylinder of soft foamed plastics material which is incorporated into a neck tunnel of the costume and which surrounds the child's neck.

4. A costume as claimed in claim 1, having a back opening closed by a zip fastener which, when fully drawn up, draws the neck roll around the child's neck.

5. A costume as claimed in claim 1, made from knitted fabric resistant to the penetration of solar ultra-violet light, the panels having zones separated by broad hinging crease lines.

6. A costume as claimed in claim 1, in which the flattened form of the panels and their incorporation in the costume's thickness, provides the outside of the costume with a relatively clean visual appearance when worn by a child.

7. A costume as claimed in claim 1, provided with two back panels each having crease lines which cross one another, and a chest panel having oppositely-curved crease lines extending from side-to-side and a central back crease line following the direction of the wearer's spine and flanked by two lateral crease lines spaced from the central crease line, each of the lateral crease lines crossing one of the curved crease lines and terminating on the other curved crease line.

8. A costume as claimed in claim 1, wherein the buoyant plastics panels include two back panels each having a longitudinal crease line an a transverse crease line crossing the longitudinal crease line.

9. A costume as claimed in claim 8, wherein the buoyant plastics panels include a chest panel having upper and lower transverse crease lines extending from side-to-side of the chest panel and a central crease line extending from an upper edge of the chest panel to a lower edge of the chest panel.

10. A costume as claimed in claim 9, wherein the chest panel has two additional crease lines spaced from the central crease line and extending from the lower edge of the panel to the upper transverse crease line.

11. A costume as claimed in claim 1, having a back opening closed by a zip fastener which, when fully drawn up, draws the neck roll around the child's neck, and wherein the buoyant plastics panels include two back panels at opposite respective sides of the zip fastener and a chest panel.

12. A swimming costume for covering a child's body while having openings for the child's arms legs and neck, the costume including:

a buoyant neck roll providing buoyancy at the child's neck;

buoyant plastics panels of flattened flexible from provided within the thickness of the costume at positions at which normal body movements of the child are not obstructed, the panels being spaced around the child's chest and upper back region and providing the costume with a relatively smooth external appearance; and means formed in the panels to facilitate flexing of the panels along predetermined lines so as to accommodate normal chest and back movements of the child occurring while swimming in water or playing on dry land, and wherein the swimming costume is provided with two back panels each having crease lines which cross one another, and a chest panel having oppositely-curved crease lines extending from side-to-side and a central back crease line following the direction of the wearer's spine and flanked by two lateral crease lines spaced from the central crease line, each of the lateral crease lines crossing one of the curved crease lines and terminating on the other curved crease line.

* * * * *